United States Patent [19]

Cusick, III et al.

[11] Patent Number: 4,702,539

[45] Date of Patent: Oct. 27, 1987

[54] CABLE CONNECTOR ASSEMBLY

[75] Inventors: Joseph B. Cusick, III, Peck; Ty A. Raney, Valley Center, both of Kans.

[73] Assignee: Tweco Products, Inc., Wichita, Kans.

[21] Appl. No.: 850,965

[22] Filed: Apr. 11, 1986

[51] Int. Cl.[4] ..... H01R 11/00

[52] U.S. Cl. ..... 439/588; 439/491; 439/894

[58] Field of Search ..... 339/278 R, 278 T, 277 R, 339/90 R, 90 C, 188 R, 188 C, 113 R, 60 R

[56] References Cited

U.S. PATENT DOCUMENTS

Re. 25,506 12/1963 Stevens, Jr. ..... 339/60 R
3,876,234 4/1975 Harms ..... 285/38

FOREIGN PATENT DOCUMENTS 1092626 5/1984 U.S.S.R. ..... 339/113 R

*Primary Examiner*—Gil Weidenfeld
*Assistant Examiner*—Paula A. Austin
*Attorney, Agent, or Firm*—Majestic, Gallagher, Parsons & Siebert

[57] ABSTRACT

A connector assembly includes first and second connectors which may be coupled by advancing a connector post on the first connector into a corresponding recess on the second connector. The assembly may then be fully engaged by 180° rotation of one of the connectors about a longitudinal axis. Indicia on the connectors enable an operator to quickly ascertain whether the assembly is in engaged or disengaged position.

7 Claims, 10 Drawing Figures

CABLE CONNECTOR ASSEMBLY

FIELD OF THE INVENTION

This invention relates generally to connector assemblies, and more particularly relates to a cable connector assembly with improved engagement means.

BACKGROUND OF THE INVENTION

Cable connector assemblies are known in a wide variety of applications. In many of these applications, superior electrical contact between two cables is desired in addition to a more secure engagement mechanism. Further, it is desirable that the connectors be durable so as to withstand heavy and continuous use. It is also desirable that a connector assembly be versatile so as to be useful in more than one application. Economy of manufacture is still an additional consideration. Positive engagement is a primary concern. There should also be some indication of engagement or disengagement which is visual or by "feel."

Many existing cable connector assemblies fail in one or more of these respects. For example, some prior art cable connector mechanisms do not provide for positive engagement. They also do not permit the operator to know when they are engaged or disengaged by sight or "feel" or both.

SUMMARY OF THE INVENTION

Accordingly, it is an object of the invention to provide a connector assembly which overcomes the aforementioned and other disadvantages.

It is another object of the invention to provide a cable connector assembly having a superior engaging mechanism.

It is still another object of the invention to provide a cable connector assembly providing a superior electrical connection between two cables.

It is yet another object of the invention to provide a cable connector assembly having external visual indicia as to its engaged or disengaged state.

It is a further object of this invention to provide a cable connector assembly which gives the operator a sense of "feel" when in the engaged or disengaged positions.

It is a further object of the invention to provide a cable connector assembly which is durable, provides an improved connection, and is relatively inexpensive to manufacture.

Additional objects, advantages and novel features of the invention will be set forth in part in the description which follows, and in part will become apparent to those skilled in the art on examination of the following, or may be learned by practice of the invention.

In one aspect of the present invention, a cable connector assembly comprises a first cable connector having a protruding connector post at one end adapted to fit a recess in a second cable connector. When coupled, one connector may be rotated 180° about the longitudinal axis of the assembly so as to engage the connectors. In order to disengage the connectors, the 180° rotation is performed in the reverse direction. This engagement-/disengagement feature is provided by an internal cam-type mechanism.

In another aspect of the present invention, the connector assembly includes external visual indicia as to its engaged or disengaged state. Each substantially cylindrical connector is provided with two opposing, differing symbols, such as a circle and a square, at the mating end thereof. Thus, when the connectors are mated but disengaged, a circle will be adjacent a circle and a square adjacent a square; correspondingly, when engaged (i.e. after 180° twist), each circle will be adjacent each square, since the symbols are on diametrically opposing sides of the connector.

Optionally, the connector post on the first connector may be provided with an asymmetric longitudinal groove extending through the post in order to reduce wear and ensure a more secure fit.

DETAILED DESCRIPTION OF THE INVENTION

Figure 1:
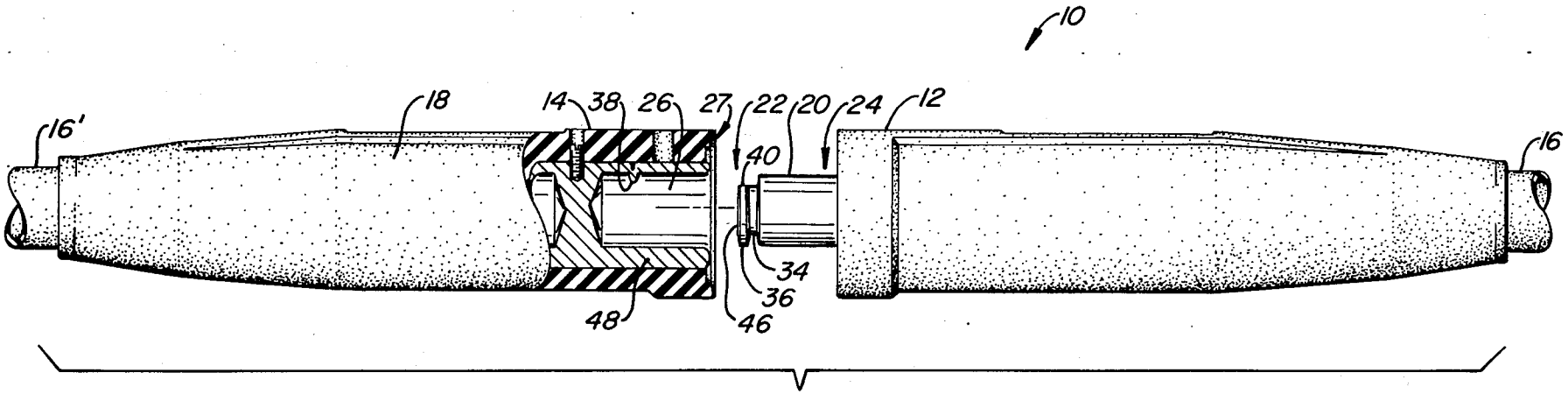
FIG. 1 is a side elevation, partially cross-sectional view of the connectors of the instant invention prior to coupling.

In FIG. 1, the connector assembly is shown generally at 10. Substantially cylindrical first and second cable connectors 12 and 14 join lengths of electrical cable 16 and 16'. Both generally elongated connector bodies are comprised of connector blocks 48 and 50 of electrically conductive material such as brass which are substantially encased in insulating material 18. Protruding at one end from first cable connector 12 is a generally cylindrical, conductive connector post 20 having a free end 22 and a fixed end 24. The connector post is adapted to fit into generally cylindrical recess 26 at the coupling end 27 of second connector 14.

Figure 3:
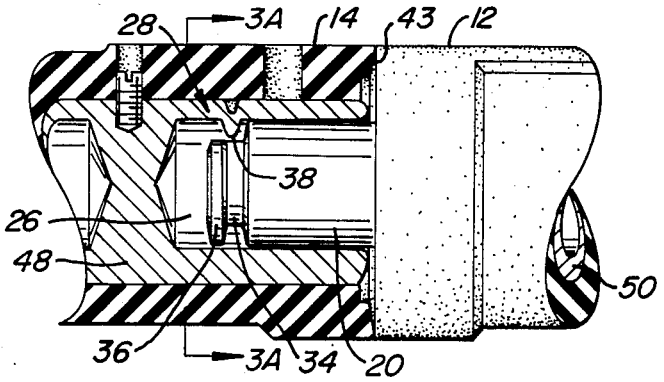
FIG. 3 is an enlarged side elevation, partially cross-sectional view of the central portion of the connector assembly in the disengaged position.
Figure 3A:
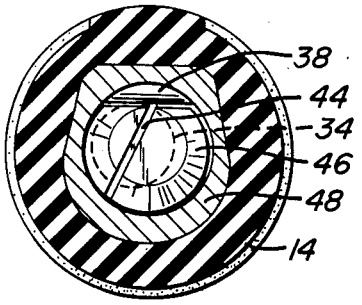
FIG. 3A is a cross-sectional view taken along lines 3A—3A of FIG. 3.
Figure 4:
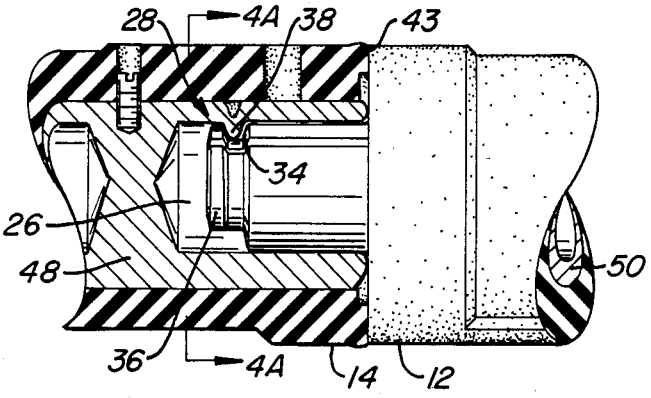
FIG. 4 is an enlarged, partially cross-sectional view similar to FIG. 3 of the central portion of the connector assembly in the engaged position.
Figure 4A:
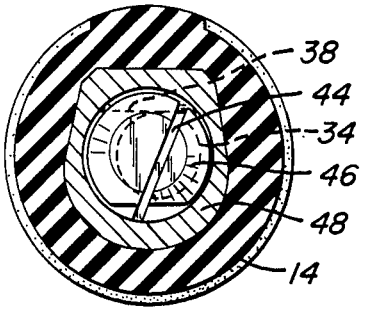
FIG. 4A is a cross-sectional view taken along lines 4A—4A in FIG. 4.
Figure 6:
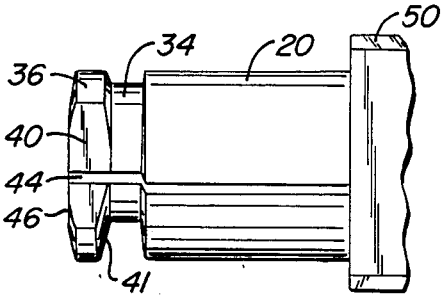
FIG. 6 is a top plan view of the connector post shown in FIG. 1.
Figure 8:
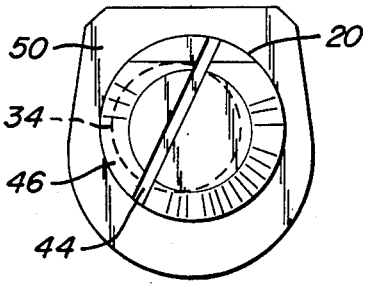
FIG. 8 is a left end elevational view of the connector post of FIG. 7.
Figure 7:
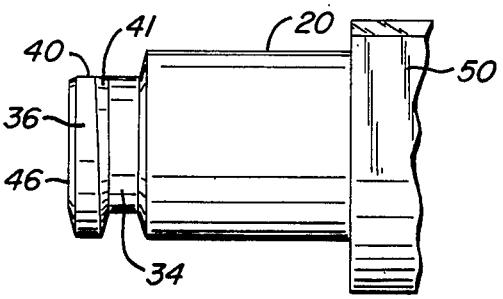
FIG. 7 is also a side elevational view of the connector post of FIG. 6.

The connectors are coupled and engaged by a cam means shown at 28 in FIGS. 3 and 4. As best seen in FIGS. 6–8, connector post 20 is provided with an asymmetric annular groove 34 which correspondingly defines a substantially annular ridge 36 at the free end of the post. Ridge 36 includes a flat section 40 which is key to the camming mechanism. It also includes an inner cam surface 41 which interacts with wedge 38 which protrudes radially inwardly from the interior of recess 26 so as to provide a "pull up" action between the connectors 12, 14. As may be seen in FIG. 4, the resilient outer casings of the connectors will be compressed at the annular area of their contact 43. This is permitted because the connector blocks, one of which is shown at 48, are normally recessed from this outermost area of contact 43. The wedging action thus produced creates a high pressure contact area between the connectors, which in turn provides a connection having a very low electrical resistance. It also reduces the possibility of environmental contamination and increases the engaging frictional forces between the connectors. As shown in FIGS. 3 and 3A, after insertion of connector post 20 into recess 26, the flat section 40 is positioned adjacent wedge 38. In this disengaged position, the connectors may be quickly and easily uncoupled. In order to engage the connectors together after coupling, one of the connectors may be rotated 180° around the longitudinal axis of the connector assembly to yield the fully engaged structure shown in FIGS. 4 and 4A. In this engaged position, as FIG. 4A illustrates, wedge 38 is positioned to be laterally juxtaposed with ridge 36 of the connector post and disengagement of the connectors without reverse rotation about the longitudinal axis is prevented.

At the same time, cam means 28 prevents inadvertent disengagement of connectors after coupling. Asymmetric annular groove 34 is dimensioned and positioned so as to prevent rotation of either connector through an angle of greater than about 180°. Thus, after 180° rotation into the engaged position, further rotation is inhibited and disengagement may only be accomplished by a 180° reverse rotation. This action gives the operator "feel" of engagement. After use, the connectors may be disengaged by, again, 180° rotation of one connector about the longitudinal axis. Connectors 18, 20 may be made of rubber or other electrically insulating material.

In a preferred embodiment and as best illustrated by FIGS. 6 and 8, connector post 20 is provided with a longitudinal groove 44 which extends through the post from face 46 to connector block 50. The groove is preferably asymmetric, as illustrated in FIG. 8. This aspect of the invention provides a linear spring action in the connector post structure, and thus ensures a more secure fit, improved electrical contact between the two connectors, and reduced wear with prolonged use. Additional rotational resistance and greater "break away" torquest are also provided.

Figure 2:
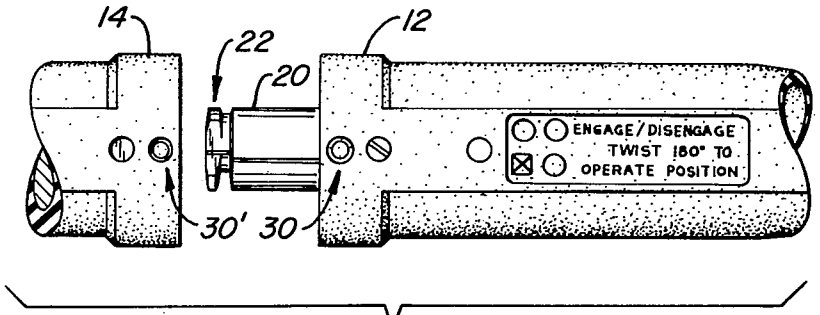
FIG. 2 is a side elevation view of the connector assembly made up of the connectors of FIG. 1 before coupling illustrating the use of external visual indicia.
Figure 5:
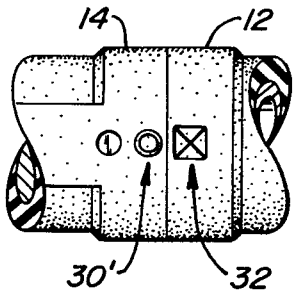
FIG. 5 is an enlarged, side view of the central portion of the connector assembly, shown in engaged position.

FIGS. 2 and 5 illustrate the use of optional external visual indicia with the present invention. First connector 12 may at its mating end be provided with two different symbols 30 and 32, shown here as a circle and a square, placed at diametrically opposed positions on the connector. Likewise, second connector 14 is provided with corresponding symbols 30' and 32' (not shown). Thus, when the connectors are coupled but not fully engaged, a circle is adjacent a circle, as shown in FIG. 2, and, on the diametrically opposed side of the connector, a square is adjacent a square. After locking, i.e. after 180° rotation of one connector with respect to the other, different symbols appear next to each other, as illustrated in FIG. 5.

While the invention has been described in conjunction with the preferred specific embodiments thereof, it will be understood that this description is intended to illustrate and not limit the scope of the invention, which is defined by the appended claims.

We claim:

1. An electrical cable assembly, comprising:

a first and a second cable connector;

means defining a generally cylindrical connector post on said first connector, said post having a fixed end and a free end;

resilient insulating material substantially encasing said first and second cable connectors;

means defining a generally cylindrical recess in said second connector, said recess adapted to receive said connector post upon coupling; and first cam means on said post and within said recess, operable by relatively rotating said connectors to pull said connector post into said recess thereby deforming said insulating material encasing said first and second cable connectors into sealing engagement, and second cam means on said post selectively engageable with said recess on relative rotation of said connectors to said position in sealing engagement so as to prevent axial removal of said connector post from said recess unless said connectors are relatively rotated substantially back to their original position prior to sealing engagement.

2. The electrical cable assembly of claim 1, further including indicia on said first and second connectors for visually indicating whether said connectors are in engaged or disengaged position.

3. The electrical cable assembly of claim 1, wherein said first and second connector blocks are comprised of electrically conductive material.

4. The electrical cable assembly of claim 1, wherein said connector post is provided with an asymmetrically positioned, offset longitudinal groove extending from the free end to the fixed end of said post which provides a linear compression spring rate for improved electrical conductivity.

5. The electrical cable assembly of claim 1, wherein said second cam means comprises an asymmetric annular groove in said post defining a substantially annular ridge at said free end of said post, a wedge in said recess extending radially inward from the interior of said recess, and a flat section on said annular ridge positioned so that upon coupling said connector post may be fully advanced into said recess, and wherein said annular groove is positioned and dimensioned so as to prevent rotation of said first or second connectors through an angle of greater than about 180° after coupling.

6. The electrical cable assembly of claim 5, wherein said first connector has a generally elongated body having a first connector block within one end thereof including said connector post, and said second connector has a generally elongated body having a second connector block within one end thereof including said recess.

7. The electrical cable assembly of claim 6 wherein said elongated bodies are made of a resilient material, said connector blocks being positioned within said bodies so that said connectors contact each other over an annular area of contact when in the coupled position, and wherein the first cam means comprises a portion of the wedge and said annular ridge on the end of post, said ridge having an inner cam surface thereon which interacts with said portion of the wedge as said connectors are relatively rotated into the engaged position so that said connectors are axially moved toward each other so as to compress their resilient bodies over their area of contact thereby reducing the possibility of contamination and providing greater engaging forces between the connectors.

* * * * *